United States Patent [19]

Miles

[11] Patent Number: 4,597,211

[45] Date of Patent: Jul. 1, 1986

[54] SELF-ALTERNATING REAR SIGHTS FOR DOUBLE-BARREL FIREARMS

[76] Inventor: Paul S. Miles, 5/61 Vanberg Road, Essendon, Victoria 3040, Australia

[21] Appl. No.: 523,331

[22] Filed: Aug. 15, 1983

[51] Int. Cl.[4] ..... F41G 1/16

[52] U.S. Cl. ..... 42/1 S; 33/233; 33/253; 33/261

[58] Field of Search ..... 42/1 S; 33/233, 252, 33/253, 261

[56] References Cited

U.S. PATENT DOCUMENTS

| | | | |
|---|---|---|---|
| 1,089,009 | 3/1914 | Porter | 33/252 |
| 3,955,299 | 5/1976 | Bullis | 42/1 S |
| 4,008,536 | 2/1977 | Adams | 42/1 S |

*Primary Examiner*—Charles T. Jordan

[57] ABSTRACT

Sights for regulating double rifles, and shotguns firing rifled slugs, to converge projectile impacts of the two barrels. Several distinct embodiments activated by inertia or the firearm's mechanism, all providing two adjustable sight leaves, one to be aligned with the impact point of each barrel. In the preferred embodiments the upstanding sight used for aiming a first shot is exchanged at the shot for the second sight by recoil inertia harnessed in one of three ways. One embodiment is reset by cooperation with the firearm but alternated by inertia, while another inertia type is reset manually. A detachable embodiment is provided for shotguns with ventilated ribs, which is both alternated and reset by inertia. A sight activated solely by the firearm's mechanism is also provided.

16 Claims, 25 Drawing Figures

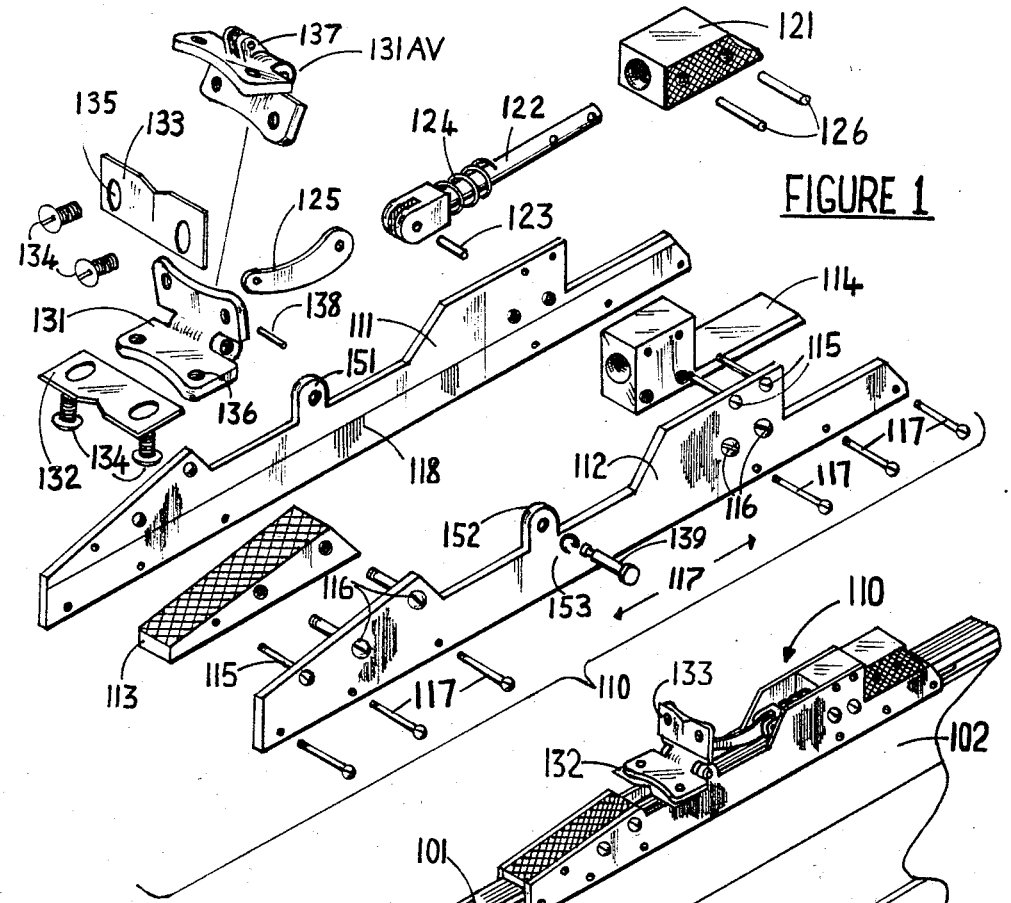
FIGURE 1
FIG. 2
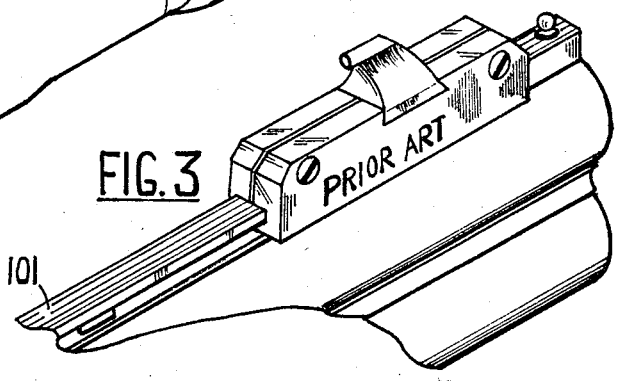
FIG. 3

310
210
212
213
321
331
332
333
334
335
336
337
338
339
340
341
342
343
344

SELF-ALTERNATING REAR SIGHTS FOR DOUBLE-BARREL FIREARMS

CROSS REFERENCES

Australian Provisional Specifications:
Reciprocating Inertia Sight PF 5444 18.8.82.
Self-Cocking Inertia Sight PF 5546 25.8.82.
Improvements to Reciprocating Inertia Sight PF 5779 8.9.82.
Self-Alternating Double-Rifle Sights PF 7588 13.1.83.

FIELD OF THE INVENTION

This invention relates to fixed or detachable rear sights for double-barrel rifles and shotguns from which single projectiles are to be fired.

More specifically it relates to sights and other means and processes for such arms which overcome problems of divergent projectile impact from each barrel.

DISCUSSION OF PRIOR ART

Heretofore double-barrel rifles were notoriously difficult to build, mainly because of the difficulty of getting the barrels to fire their projectiles to the same point at any distance.

Because, double-barrel weapons always have at least one barrel outside the longitudinal axis of the arm, the recoil, vibrations and thus bullet flight paths of each barrel will be different unless the barrels are subtly regulated to make their bullet impact points at a certain distance coincide. If side-by-side rifles, for instance, had exactly parellel barrels, recoil would pull bullets from the right barrel to the right of the target, because that barrel was to the right of the gun's longitudinal axis, and the (generally) axis-aligned butt plate acts as a pivot point. The left barrel would shoot to the left.

An under/over rifle would, on the other hand throw the bullet from the upper barrel much higher than from the lower one (if the barrels were parallel) as the upper barrel is further above the longitudinal axis than the lower barrel.

Therefore, double rifles (and guns) are generally made with the bores closer together at the muzzles than at the breech, to overcome the abovementioned divergence problems.

The real difficulty is knowing how much distance to allow between the muzzles. Variables such as bullet weights, and individual differences between arms have caused traditional makers to regulate each rifle individually to be certain of good accuracy, and to specify the exact ammunition to be used in it.

This hand regulation added so much to the cost of the arm that any other efforts to save production costs seemed pointless, causing most makers to make the whole gun by hand, often adding unnecessary refinements to help justify the now exhorbitant price.

Thus the beauty and many advantages of double rifles have heretofore been too costly for most hunters. Double-barrel shotguns on the other hand, have been much easier to make cheaply because of the short range, spreading nature of the shot charges, which makes minor misalignment of the barrels unimportant. When using single, rifled slugs for deer and other game larger than birds and foxes however, correct alignment of the projectiles' impact is most important. Because most makers have not worried about this aspect when making double shotguns, the use of rifled slugs has heretofore generally been practical only in single-barrel guns, for which either special rifle-sighted barrels or detachable rifle-type sights were available.

The normal ways of fixing sights to firearms are to solder, dovetail or screw them to the barrel, barrel rib or other metalwork. Such methods are part of firearms art. Most embodiments of my invention would be either screwed to the barrels of the arm or to the rib of between-barrel metal. The reciprocating embodiment as shown on Sheet 1 of the drawings (FIGS. 1 & 2), however, would be clamped to a ventilated rib of a shotgun, from which it could be easily detached without marring the gun's finish. This method of mounting may be compared roughly with the open sight mounts of Adam's U.S. Pat. No. 4,008,536, though Adams uses either a much more elaborately machined two-piece mount or a simple (though finely machined) one-piece mount, neither of which doubles as the frame for an articulated device with moving parts as my mounting clamps do.

The front sight shown in FIG. 3 is straight from Adams, and suggested as representative of what is required at the muzzle of a shotgun for use with rifled slugs when a higher rear sight of any kind is mounted. Other front sights such as one adhered to the ventilated rib would be almost as good. An adherable mount for a front sight pointing aid is provided by Normark Corporation of Minneapolis Minn, according to Adams.

If the body of the reciprocating-inertia embodiment of my sight were made of plastic, in one piece, and lightweight components (other than inertia weight and sight bracket) used, double-sided adhesive tape would probably also be suitable for holding the rear sight in place especially if the bearing surface of the tape and sight were extended by adding to the length of the matted ramp 213.

The use of replaceable tape for mounting rear and fore sights on one mount is provided by Slug Site Co., White Tail Wilds, Lake Hubert MN.

Though the above mounting systems all have relevance to my art, they do not have any direct bearing on the most innovative aspects claimed for my sights.

Regulating the bullet impacts of double rifles by methods other than the traditional one of installing wedges of different sizes (I believe) between the muzzles, firing the rifle, and changing the wedges until the correct result is achieved, before soldering the barrels together along their lengths, has recently been losing favour.

Several European makers such as Krieghoff and Valmet have left the barrels of their O/U double rifles unjoined for much of their lengths, and join them at the muzzle with clamp-like regulating means. Though such systems may well cut production costs and be easily readjusted if necessary, they are a sharp departure from accepted aesthetics, and being quite bulky, do not offer any provision for side-by-side rifles. Further, they do not offer any help to hunters wishing to fire rifled slugs through existing double shotguns or wishing to re-regulate a traditionally made double rifle, which has either lost its convergence or is required to fire bullets or loads different from those intended for it. Moreover, they do not facilitate the production of traditionally attractive rifles on a high speed production basis, a proportion of which are likely to be quite accurate without special sights or new and/or bulky regulating provisions.

U.S. Pat. No. 3,955,299 to Bullis (assignee: Remington Arms Co. Inc.) provides an adjustable muzzle spacer, mainly for shotguns but applicable to U/O rifles, which is less obtrusive than the abovementioned clamps. The other clamp deficiencies would apply however, and this spacer may not withstand the violent vibrations and recoil of some high-powered rifle cartridges.

Though the above provisions may be used to achieve the same regulating purpose as my art, they are not in any way connected with my approach to the problem.

OBJECTS OF THE INVENTION

My invention is intended to solve the problem of making single projectiles, fired from each barrel of a double-barrel rifle or shotgun, shoot to the same point at a selected distance, by the provision of an adjustable, instantly alternated rear-sight leaf for each barrel, rather than by the expensive and difficult process of varying the distances between the muzzles of the barrels.

Within this general objective, the several preferred embodiments are directed with various applicability to the following specialised purpose.

(1) To regulate the points of impact of rifled slugs when fired from existing double-barrel shotguns.

(2) To provide a readily detachable sight which achieves the objects of 1).

(3) To regulate without expensive handfitting, special slug-firing barrels for double-barrel shotguns.

(4) To re-regulate existing badly adjusted or climate-affected double rifles without recourse to factory or gunsmith.

(5) To allow owners of existing double rifles to use with accuracy cartridges or bullet weights other than those for which the rifle was regulated by the maker.

(6) To bring the regulating of double barrel rifles and slug-firing shotguns within the capabilities of a person of ordinary mechanical skill, using tools commonly found in home workshops.

(7) To allow the mass production of double rifles on modern machinery, by removing the enormous expense of barrel regulating which has heretofore kept costs so high and production so low that mechanisation was rarely worthwhile, thus making the whole rifle much dearer than even the hand-regulating of barrels could explain.

(8) To facilitate the production of double-barrel rifles with conventional, fixed and folding leaves by mass production, by reserving for this purpose that proportion of the mass-produced rifles as proposed in 7 which exhibit good convergence and accuracy during testing after manufacture.

(9) To provide fold-away long-range alternating sights for double-barrel rifles which have satisfactory accuracy at close or medium ranges with conventional sights, but which lose their convergence at greater distances.

Further objects and advantages of my invention will become apparent from a consideration of the drawings and ensuing description thereof.

BRIEF DESCRIPTION OF DRAWINGS

FIG. 1. is an exploded view of a simple version of the reciprocating inertia embodiment of the invention.

FIG. 2 is an assembled, pictorial view of FIG. 1, mounted on the ventilated rib of an O/U shotgun.

FIG. 3 is an example of the kind of front sight required on a shotgun when an auxiliary rear sight higher than the shotgun's bead front sight, such as in FIG. 1, is employed. The sight shown is from Adams (U.S. Pat. No. 4,008,536).

DESCRIPTIONS OF THE PREFERRED EMBODIMENTS

Figure 4:
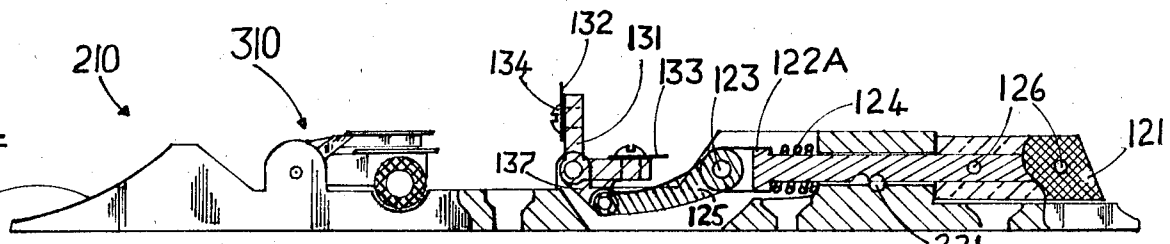
FIG. 4 shows a central-line view of the reciprocating-inertia part of a slightly more sophistocated version of FIGS. 1 and 2, incorporating a drop-down-inertia embodiment at the rear as a long range sight, a one-piece body and provision for screwing the sight assembly onto the gun or rifle rather that clamping it as in FIGS. 1 and 2.

Reference may now be made to FIGS. 1 and 2 and FIGS. 4, 5, 6, and 7. Though these sights have different body structures which may be made from different materials, and though the sight of FIGS. 4, 5, 6 and 7 has an additional sighting means mounted behind it, many of the parts are common to both sights and both function in the same way most of the time, despite cosmetic differences. Common part numbers are used where possible.

FIGS. 1 and 2 show a preferred detachable embodiment for use on shotguns with ventilated ribs. All parts of this sight, other than the inertia weight 121, the replaceable rubber membrane 118, and optionally the sight bracket 131, may be made of steel or lighter alloys (given provision for threadably engaging required body screws). Weight 121 should be brass, or steel with lead core. Bracket 131 may be brass if desired for ease of manufacture or ease of functioning.

Frame members 111 and 112, sandwiching the knurled-top ramp 113 and inertia shaft housing 114, are held together by the upper body screws 115 (small) and 116 (large), fitting into corresponding holes in each part, and engaging the threads in the holes of the left-hand frame member 111.

Sight bracket 131 is a steel or brass, right-angled mounting piece with a hinge pin aperture through the intersection of the bracket angles, and two bracket-rotation lugs 137 with pin holes 45° around from the axis of the host bracket angle (in relation to the hinge pin aperture). These lugs are shown pictorially in the alternative view of 131, the sight bracket 131 AV, FIG. 1. As shown in the lower view of 131, the rear-most angle of the bracket may be slightly longer on O/U guns (thicker on side-by-side types). This is to allow for the greater elevation often needed for the lower barrel (of O/U guns) and to counter-balance the lugs 137 and connecting piece 125. Note FIG. 2 shows the sight leaves 132 and 133 are fixed on to the perpendicular faces of sight bracket 131 by screws 134 which fit through the slotted elevation-adjustment holes (e.g. 135) and engage the threaded holes (e.g. 136). Sight leaves should be fixed on the sides of the bracket angles presented to shooter, with "V" notches upper-most. Substitute leaves may be used to adjust windage, unless a more sophisticated sight with dovetailed bracket angles or other means is desired.

The connecting piece 125 is linked to the bracket-rotation lugs 137 by the pin 138. Connecting piece 125 connects with the inertia shaft 122 by pin 123 (see perspective view in FIG. 2 and section view in FIG. 4—the inertia shaft's part number suffix "A" signifies only that the shaft has a notch to accept the cross bolt 221). With the inertia spring 124 on the shaft 122 (as shown in FIG. 1) the shaft is positioned in the housing 114, (part of body 210 in FIG. 7) held against the spring's half-compressed state by the inertia weight 121, secured to shaft 122 by the pins 126, and bearing against the front wall of inertia shaft housing 114. Hinge pin 139 is inserted through the bracket mounting lug 152, hinge pin aperture in sight bracket 131, and bracket mounting lug 151, and is secured on the left side by circlip 153.

The weights and values needed for spring 124, inertia weight 121 and (to a lesser degree) sight bracket 131, will depend of the recoil of cartridge, weight of firearm and smoothness of sight's functioning due to manufacturing care. Given an adequate inertia weight, such values should not be critical but will affect overall size and wearing rates.

Referring now to FIG. 2, shotgun 100 is provided with a ventilated rib 101 along the barrel 102. Sight 110, the central body parts, ramp 113 and shaft housing 114, of which are machined to precisely the width of vent-rib 101 (plus allowance for protective rubber membrane—FIG. 1, 118—of frame members 111 and 112), is clampably attached to vent-rib 101 by the tightening of the body screws 115 and 116 and the lower mounting screws 117.

Bracket 131 must be slightly narrower between lugs 151 and 152 than the widths of ramp 113 and shaft housing 114, to ensure reliable rotation of the aiming means.

Figure 6:
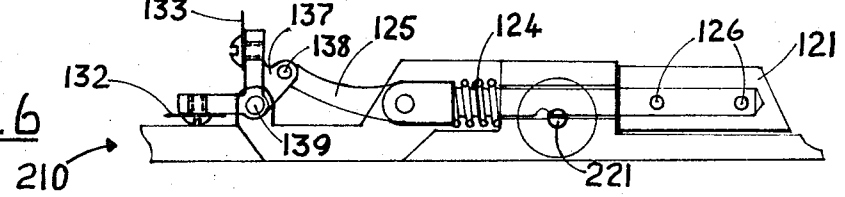
FIG. 6 shows the sight of FIGS. 4 and 5 after recoil, when the sight bracket has moved through the position of FIG. 5, under momentum, and as the inertia weight has returned to its FIG. 4 position, the sight bracket has come to rest presenting its second sight leaf for the aiming of the second shot.
Figure 7:
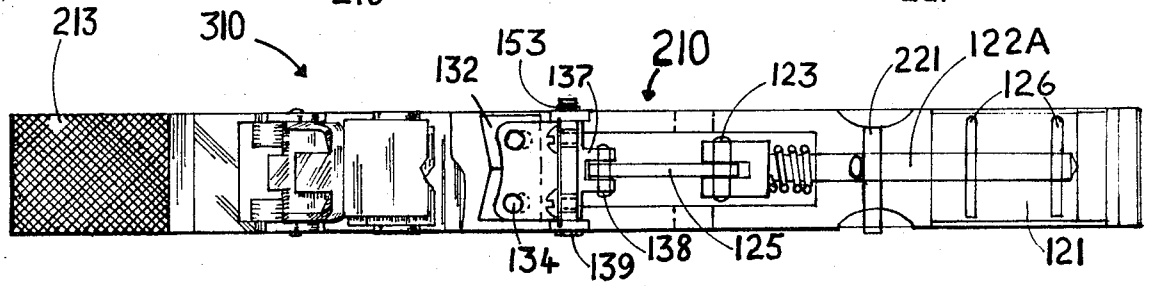
FIG. 7 shows a plan of FIG. 4 but with the sight bracket 131 in the FIG. 6 position to give a better view of the connecting piece 125 and bracket-rotation lugs 137.

Referring now to FIGS. 4, 7, 8, 9, 10 & 11. This is a preferred embodiment for use as an auxiliary, long-range aiming means on other self-alternating-leaf sights such as shown in FIGS. 4 & 7, or as an auxiliary long-range sight for use on double rifles or guns which are satisfactorily accurate with conventional fixed or folding rear sights at normal hunting ranges, but which lose their convergence at greater distances. It is shown as a fitment to the sight of FIGS. 4, 5, 6 & 7.

Referring now to FIG. 8, plan and side view of the embodiment 310, the bracket-mounting lugs 212 and backrest 213 are formed from the parent-sight body 210 material and may therefore be of any material such as steel, alloy or plastic.

Figures 8A, 8B, 9, 10, 11:
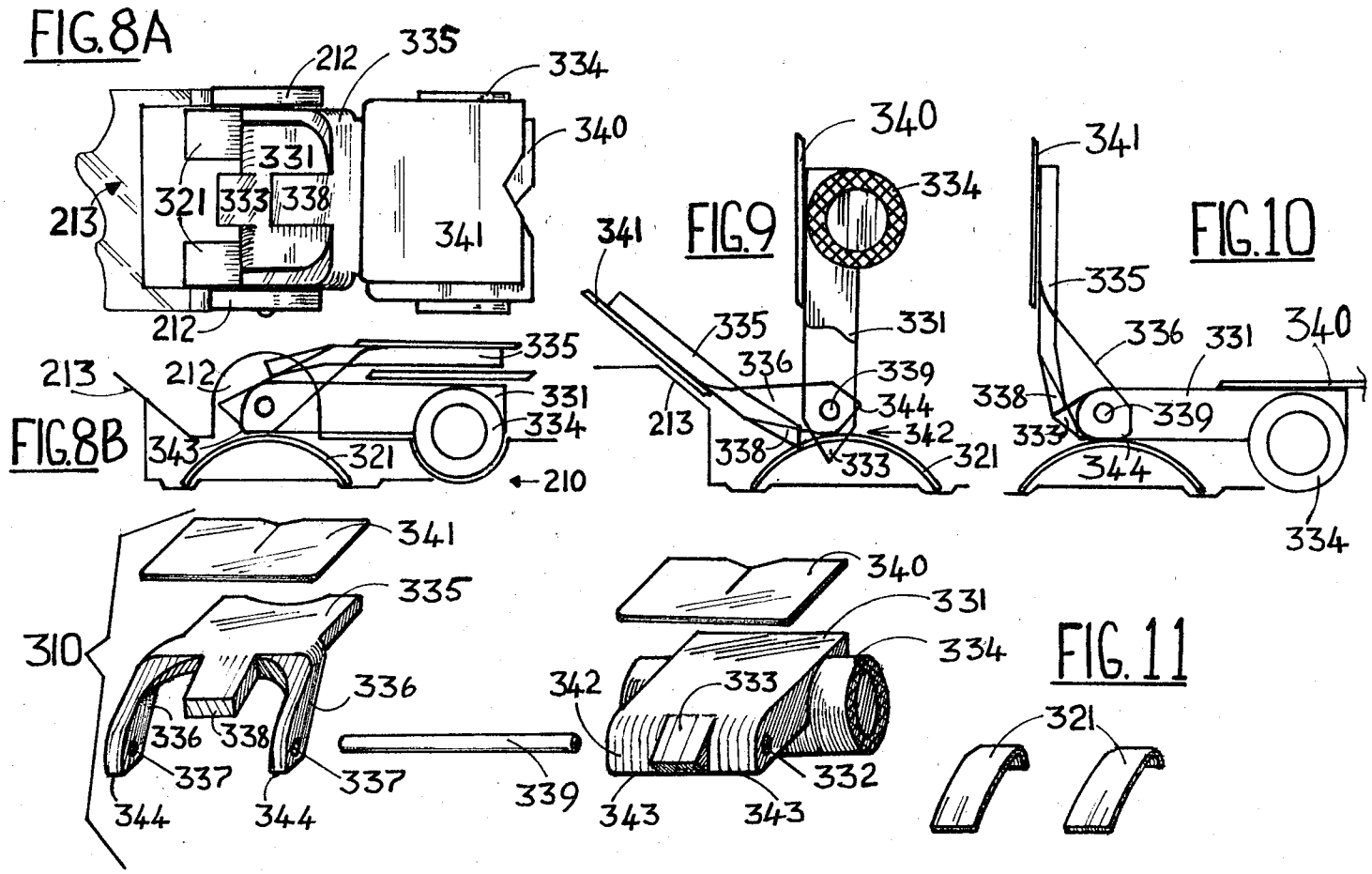
FIG. 8A shows a plan of the 'drop-down' embodiment shown in FIG. 4.
FIG. 8B shows a visible elevation of the sight of FIG. 4.
FIG. 9 is a visible elevation view of the sight of FIG. 8 when it is set for use.
FIG. 10 is the sight of FIG. 9 after the first shot has been fired and the second leaf is presented for use.
FIG. 11 is an exploded view of the sight in FIGS. 8, 9, & 10.

Referring now to FIG. 11, an exploded pictorial view of sight 310 minus the body and bracket mounting lugs of the parent sight. The semi-eliptical springs 321 lie in recesses in the body as shown in FIGS. 8, 9, and 10. Sight bracket 331 is a steel block with a hinge-pin hole 332, angular tripping extension 333 and radiused edges at one end and a wide, lead-cored ineria drum 334 with knurled resetting grips at each side, at the other end.

Sight bracket 335 is a thinner piece of light weight alloy or pressed steel, formed with two arms 336 extending from one end, which also have hinge-pin holes (337) and spring-engaging angles (e.g. 344) formed at the ends. Bracket 335 also has a tripping piece 338 extending from between the arms 336, and bent down slightly.

Referring now to the elevation view of FIG. 8, the sight is assembled by placing sight bracket 331 between the bracket lugs 212 with the inertia drum 334 lying in its recess in the body 210. Sight bracket 335 is positioned over bracket 331 with its hinge-pin holes in line with the holes in bracket-mounting lugs 212, downward pressure on the brackets and springs 321 being applied if necessary to achieve this. Hinge pin 339 is inserted through the pin holes of the bracket mounting lugs 212, the holes 337 in sight bracket 335 and the hinge-pin hole 332 in sight bracket 331. The sight leaves 340 and 341 are adherably attached in their positions on the upper surfaces of bracket 331 and 335 using a strong glue such as epoxy resin.

From an adjustment point of view, the provision of screw-slotted holes in the sight leaves 340 and 341, and threaded holes in the sight brackets as employed in other embodiments of the invention would be desirable and possible. It is felt however, that such a measure would sacrifice the compactness of this embodiment, an important consideration when used on the otherwise streamlined quarter-ribs of conventional double rifles.

Referring now to FIGS. 12 through 21. This is a preferred embodiment for permanent installation on double rifles and special shotgun barrel sets for use with rifled slugs. Once more there are two variations of the sight, a simple version as shown in FIGS. 12, 13, 19 & 20, and a more complex version seen in FIGS. 14, 15, 16, 17, 18 and 21. Comparable parts are given the same item numbers in the second variation (FIGS. 14–18 and 21) with an "A" suffix added where these parts differ materially from those of the first variation.

Figure 12:
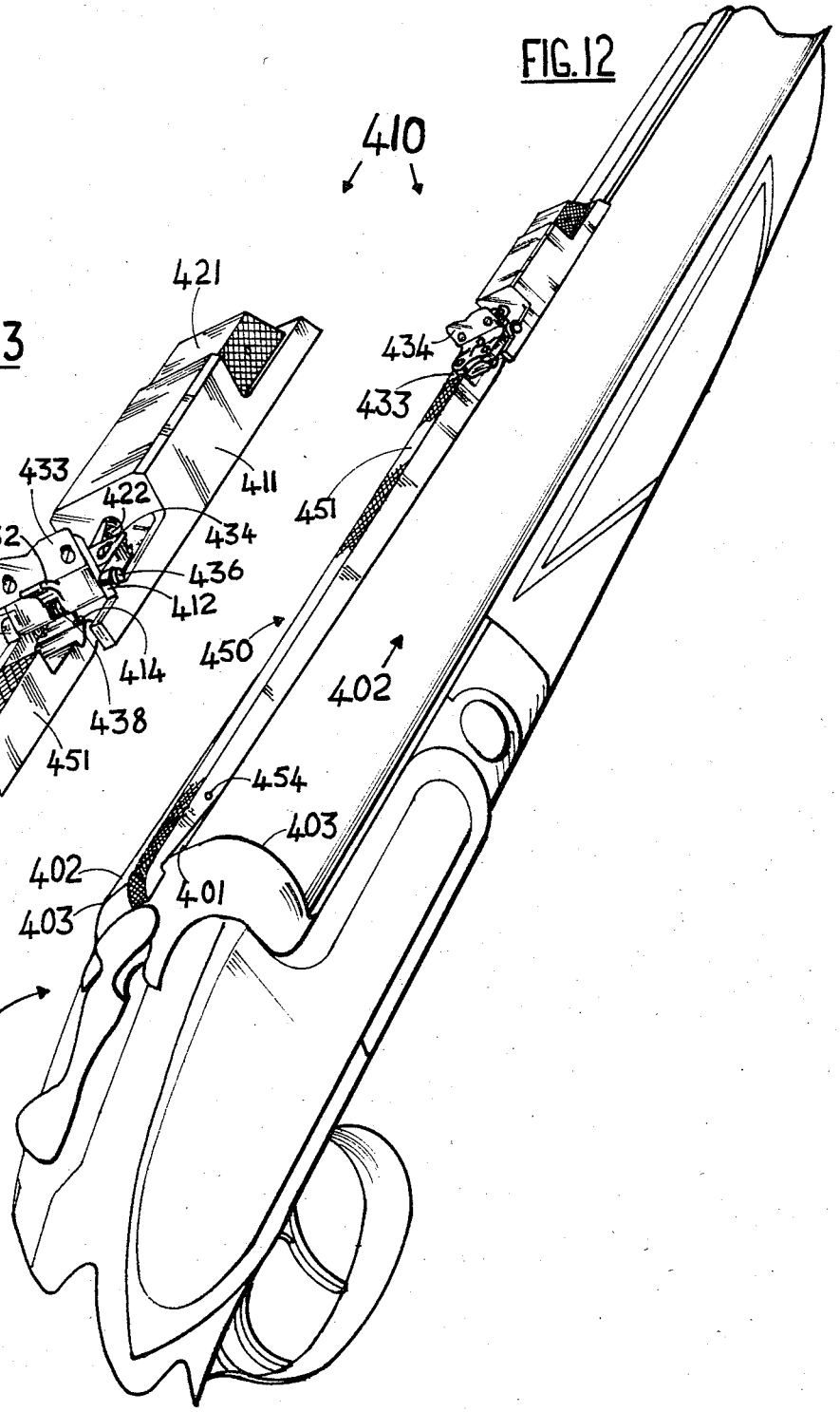
FIG. 12 is a pictorial view of the third preferred embodiment the self cocking inertia type shown uncocked mounted by screws or solder to a side-by-side double rifle or shotgun.
Figure 13:
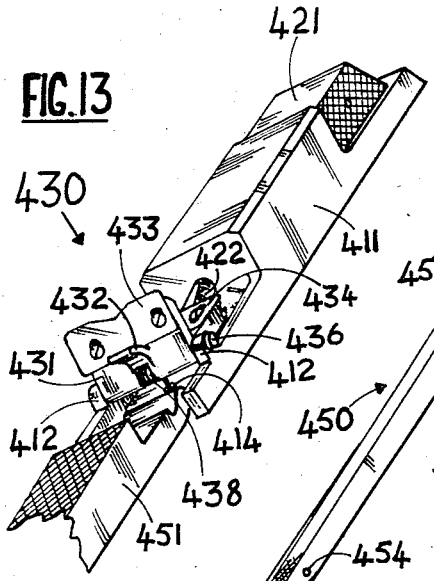
FIG. 13 is an enlarged detail of the sight of FIG. 12, shown in the cocked position.

Referring now to FIGS. 12 & 13, the sight 410 is installed permanently on the metal 401 between the barrels 402, ahead of the breech 403 of the firearm 400. This sight may also be used on O/U rifles or guns. The sight body 411 is threadably attached by a screw (not shown) beneath the inertia weight 421 and at the rear by another screw ahead of the sight leaf assembly 430 (please see similar screw location shown in FIG. 14, item 419) such a structure may be soldered in place if preferred. The sight body (411), made of steel or alloy as required, contains a housing for the inertia shaft assembly comprising inertia shaft 422, spring 423, threaded retaining collar 424 and inertia weight 421, as well as providing bracket mounting lugs 412 and spring recess beneath for mounting the sight leaf assembly 430. (The interior of the sight body's inertia shaft housing may be compared with that shown in FIG. 14). The retaining collar 424 is screwed in behind the inertia shaft 422 and spring 423, and tightened by a divided-blade screwdriver engaged in the slot 425. The brass inertia weight 421 is placed over the exposed shaft and retained by the pin 426.

Cocking lever 451 is a steel piece, with file-cut or knurled topsurface, which extends from behind the standing breech 403 to as far down the barrels as to allow the rear sights to be seen clearly. It is fastened to the metalwork between the barrels a short distance in front of the breech by the pin 454 and lever hinge 452 which is threadably attached to the weapon by screws 453. Compressed beneath lever 451 is the cocking spring 455 held in place by the retaining spigot 456 which is threadably attached to the weapon's metalwork 401. These parts, hidden in FIGS. 12 & 13, may be seen in FIGS. 14, 16 & 21. These parts comprise cocking lever assembly 450.

Figure 19:
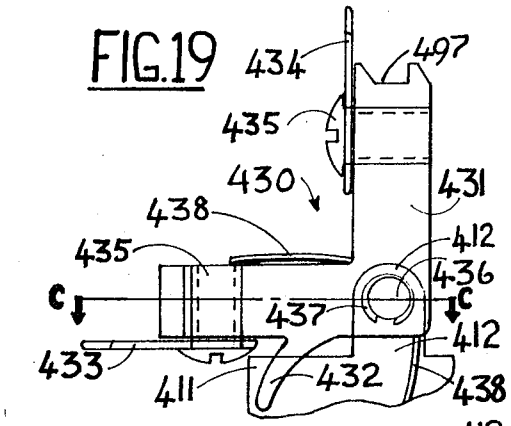
FIG. 19 is a visible elevation of the one-piece sight bracket of FIGS. 12 & 13, shown in the uncocked position.
Figure 20:
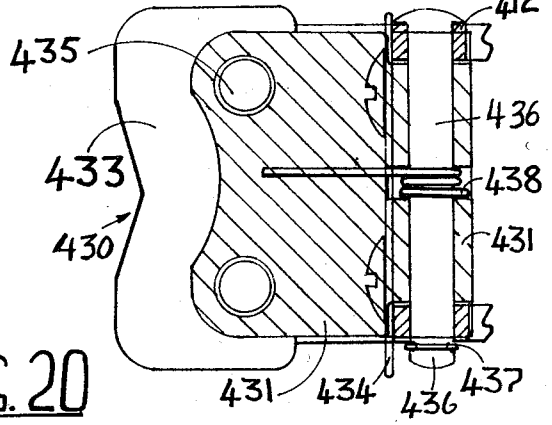
FIG. 20 is a plan of the sight bracket of FIG. 19 sectioned through the plane of the line CC.

Referring now to FIGS. 19 & 20, the sight leaf assembly 430 comprises a one-piece right-angle sight bracket 431 of steel with a hinge-pin hole through the tangent, a curved cocking spur 432 projecting from one outer surface, four threaded holes for affixing sight leaves, a recess mid-way along the elbow for a spring housing; two sight leaves 433 and 434 similar to those on the first embodiment (see FIG. 1); and four round-head screws 435 for securing the sight leaves adjustably to the sight bracket.

As with the first embodiment, a range of sight leaves should be provided with each sight, having the securing/adjusting slots in different lateral locations to provide the necessary windage adjustments. These may be reversed to allow one leaf to provide either left or right hand adjustment. With this variation, a shooter could use extra, preset sight-leaf assemblies (430) for use with different weights of bullets, or powder charges.

Referring now to FIGS. 14 through 18 and 21. This sight, 410A, varies from that of FIGS. 12, 13, 19 and 20 in having a modified body 411A with off-set lugs 412A, to accomodate the folding sight-leaf assembly 430A; a fixed close-range sight (470); and an emergency release lever 461, which hinges on pin 462. To accommodate release lever 461 the body 411A is lengthened to locate screw 419A ahead of the inertia weight 421A instead of beneath it. Also ahead of the weight is the concave 464 which houses the knurled button end of lever 461 and joins the tapered slot cutout 463 in the body, beneath the location of inertia weight 421A, which opens out in front of the inertia shaft housing where the hinge pin aperture 465 runs laterally through the body. Also formed in the body 411A ahead of the box-shaped inertia shaft housing are grooves 413, on each side of the release lever cut-out 463 which locate the rail portions beneath inertia weight 421A.

Inertia weight 421A is further modified by having a contoured recess, beneath and around the shaft-connection hole, for accepting the "buckhorn" connecting means of the lever 461. The short length of these "buck horns" compared with the length of the lever 461's button ended arm, may require a hollow beneath the sight body in the firearm's metal (FIG. 14, 401) to allow the lever 461 sufficient movement to perform its function reliably.

The main departure of the body 411A from body 411 shown in FIGS. 12, 13, 19 and 20, however, is the provision of off-set lugs 421A to allow the use of the folding sight-leaf bracket assembly 430A.

Though the asymmetry of this arrangement suggest having the sight body 411A cast with the bracket lugs 412A included, the body could be machined and the lugs 412A welded on, or with modified shape, threadably attached afterwards. Two small holes 414 A are provided in the body for anchoring sight springs 485. The left hand hole is located on the wall of this sight body behind the left hand bracket lug 412A. The body 411A also provides a dovetailed slot 471 above the inertia-shaft housing, for securing the fixed, tangent rear sight 470, for use at close range.

Sight 470 has a slight taper along its base to facilitate easy entrance of the slot 471, but tight fitting once driven to the centre of the slot. Elevation adjustment for the wide "V" rear sight 470 is by stoning either the "V" notch or the arm's front sight.

The sight assembly 430A differs significantly from the sight assembly 430 shown in FIGS. 12, 13, 19 & 20., in that the sight bracket is made in three pieces (to make it foldable and to avoid the need to cast this part). The assembled relationship of parts in the sight assembly 430A is best seen in FIG. 18, showing the sight's folded position (employed when the close-range fixed sight 470 is being used).

Figure 17:
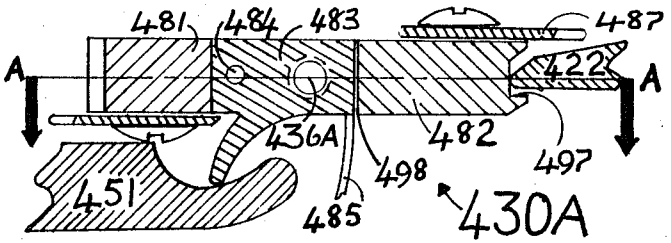
FIG. 17 is a side view section fo the sight bracket assembly of the sight of FIGS. 14, 15 & 16, shown in the folded flat position for use of lower, fixed, close range sight 470 of FIGS. 14, 15 and 16. The sectioned plane is indicated by the line BB in FIG. 18.
Figure 18:
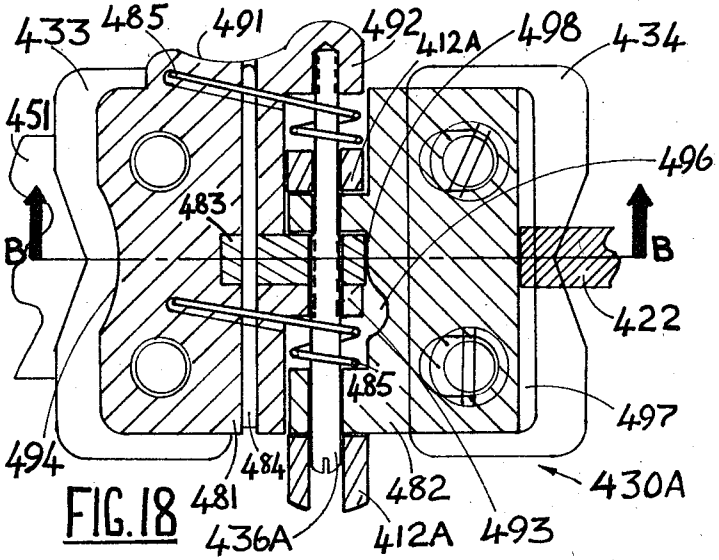
FIG. 18 is a sectioned plan of the sight in FIG. 17 indicated by the section line A.A.
Figure 21:
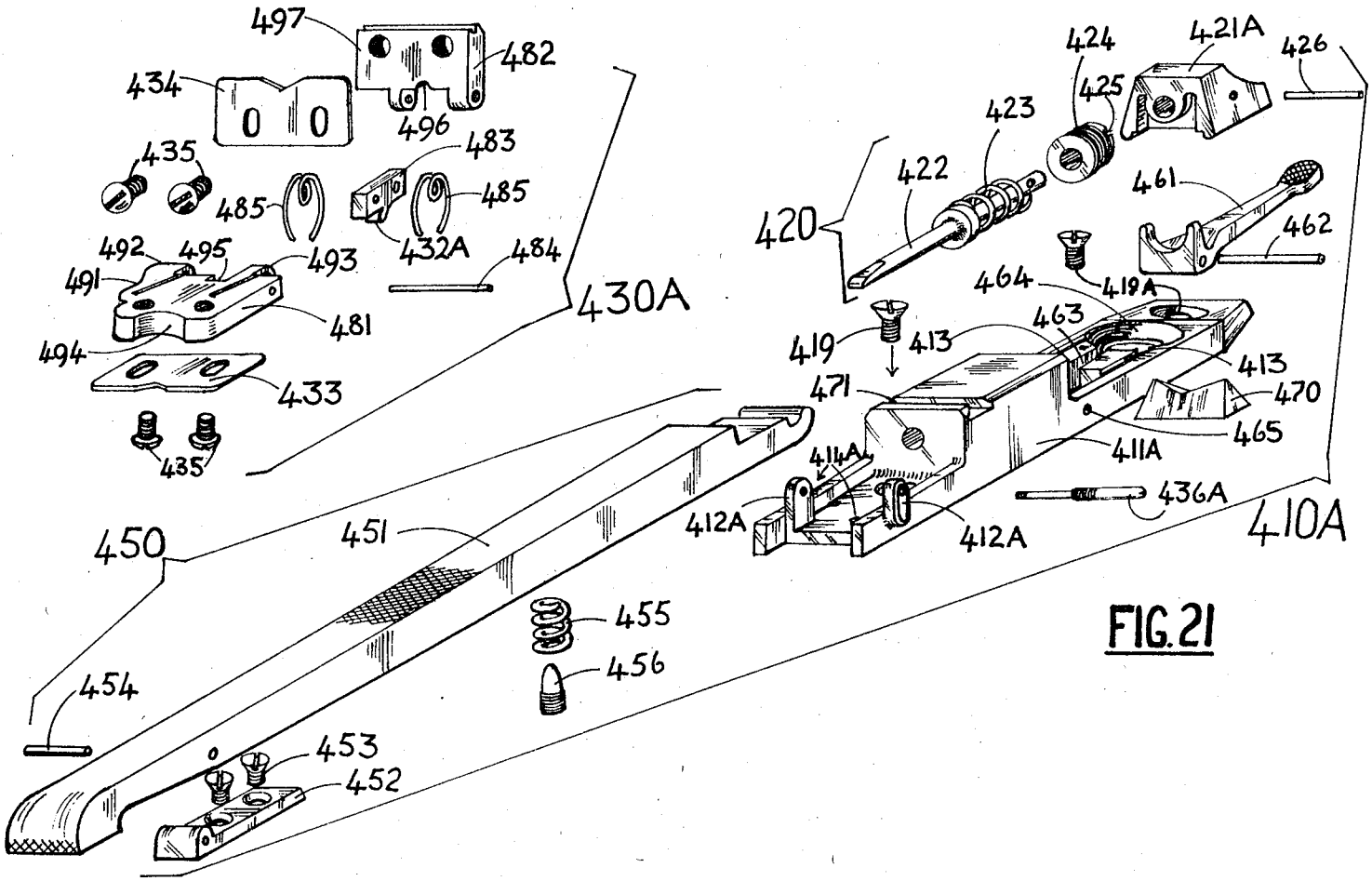
FIG. 21 is an exploded view of the embodiment represented in FIGS. 14, 15, 16, 17 & 18. This view is also of help understanding the simpler version of this embodiment shown in FIGS. 12, 13, 19 & 20 if the lack of folding sight bracket, fixed close range sight, and emergency release lever is envisaged.

Bracket 481 is a flat block formed to the shape shown in FIGS. 18 and 21. Curved surface 491 is a thumb grip which may be knurled for easier usage; lugs 492 and 493 both have threaded holes through them, through the hole in lug 492 is blind and of a smaller diameter than in 493. Radial indent 494 allows greater elevation adjustment in the sight leaf 433. Cocking spur bracket 483 is pinned into the recess 495 (labeled only in FIG. 21) by the pin 484 and preferably adhered to bracket 481, care being taken to ensure the larger, threaded hole is aligned with the threaded hole in lug 493. The position of the spur of cocking spur bracket 483 in relation to bracket 481 is shown in FIG. 17.

Sight Bracket 482 has two unthreaded hinge lugs projecting from one side (Ref FIG. 21). The hole in the Right Hand lug is of a larger diameter than the Left Hand lug. Between the lugs is a contured niche 496. On the opposite side of the bracket is an angular groove 497 which forms the bent into which the sear-end of the inertia shaft 422 locks when the sight is cocked.

Springs 485 are combination torsion-compression springs which act both radially through the arms and laterally through the coil(s). Such springs are available commercially, I believe, but may be made by stretching the coils of a small torsion spring.

To assemble sight assembly 430A, bracket 482 is laid on the sight body ahead of lugs 412A, with hinge lugs in line with the holes in the body's bracket mounting lugs 412A and the right hand hinge lug pressed hard against 412A. Downward pressure on the bracket rear slot 497 will engage the slot with inertia shaft 422, locking it down.

Axle 436A, which has two diameters, a threaded section on each, and a round, slotted head, is introduced into the holes in the right hand mounting lug 412A and left hand lug of bracket 482. When the axle reaches the right hand spring recess, and arm of one of the springs 485 is inserted in the right hand spring hole 414A in the body, the coil is fitted over the tip of axle 436A and the springs second arm is forced into its groove on the upper face of bracket 481 which, with cocking spur bracket attached, is positioned behind the bracket mounting lugs 412A. The left hand spring is installed using a spike or screwdriver to position the coil until the upper arm is located on the bracket's spring groove, the mounting bracket 481 forced in against bracket 482, and the axle 436A inserted through the left hand spring's coil and threadably attached to bracket 481 (and cocking spur bracket 483) at the two threaded sections. Sight Leaf 434 can now be tentatively threadabely attached to sight bracket 482 by the screws 435. Sight leaf 433 may be attached to sight bracket 481 when the sight leaf assembly 430A is converted to its perpendicular mode (see Operation). Significant windage adjustments may be made by substituting alternate sight leaves with differently positioned screw-adjustment slots.

Figure 22:
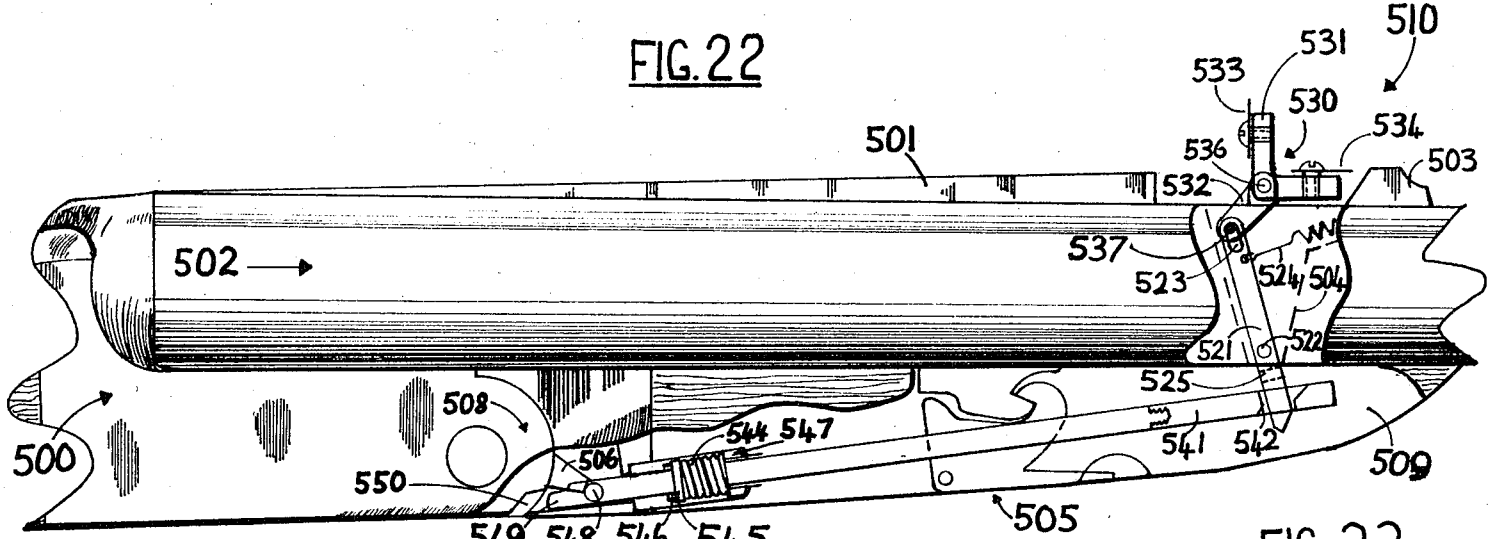
FIG. 22 is a cut-away elevation of the fourth distinct embodiment of my invention which alternates the rear sight leaves by the mechanical action of the firearm on which it is installed.
Figure 23:
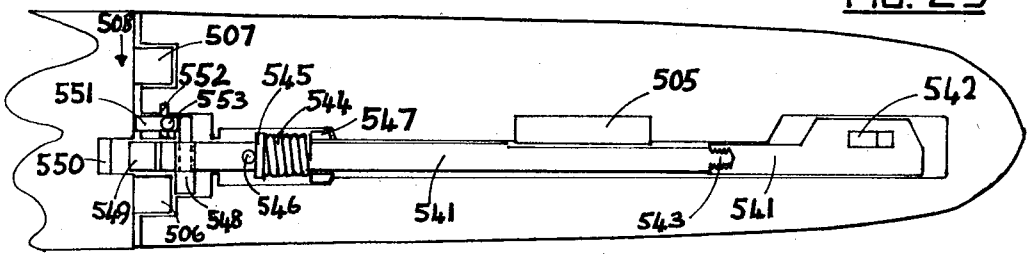
FIG. 23 shows a plan view of the cocking rod within the gun's fore end of the sight of FIG. 22.
Figure 24:
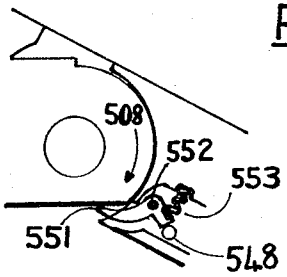
FIG. 24 shows a detail of the retaining catch of the sight of FIGS. 22 and 23 when the rifle is broken open.

Referring now to FIGS. 22, 23 and 24. This is not a preferred embodiment, but an obvious alternative to the inertia sights described so far, over which it has some theoretical advantages. FIG. 22 shows a side-by-side double rifle 500 with a mechanically operated alternating rear sight 510 built into it. Sight leaf assembly 530 consists of a one piece right-angle-profile sight bracket 531, with sight leaves 533 and 534 threadably attached in the manner used on embodiments previously described. Bracket 531, which is hinged between two mounting lugs on the circlip-retained hinge pin 536, has a pair of lugs 532 projecting from the middle of the bracket tangent 135 degrees around from either side of the bracket right angle. These lugs, which project into a gap between the rifle's barrels 502, are quite close together (compare with lugs 137 on bracket 131 AV in FIG. 1.) and are connected by a pin 537 to lever 521 which works between the barrels 502 and is hinged on the pin 522 which is soldered to the barrels just above the fore end 509. The slot 523 in lever 521 allows bracket lug 532 to rotate to the opposite side of its between-barrel gap (indicated by the dotted line 504) without being fouled by the opposing arc of lever 521. Spring 524 has the sole purpose of returning lever 521 to its "second-barrel" position when forend 509 is removed, so that reassembly can be accomplished without special thought for the sighting equipment. The spring is anchored beneath the quarter-rib extension 503. Dotted lines 525 indicate the cranking of lever 521 to make it join the operating rod 541 in the fore end which is placed to the right of the rifle's vertical axis.

Operating rod 541 is offset, to avoid the fore end catch assembly 505 and to locate the rod closer to the rifle's RH cocking lever 506. Lever 521 engages with the slot 542 when the fore end is installed. Slot 542 is offset also to save overcranking lever 521. The operating rod is square sectioned except at slot 542, at the point where it is shaved on the left side to pass fore end catch assembly 505, and at the tip 549 protruding from the fore end iron.

It runs in a round channel in the fore end woodwork however, which is routed out near the fore end tip to allow access to and working room for the wider slot end of operating rod 541.

To facilitate assembly the operating rod is made in two parts, threadably attached at 543. Where the fore end joins the fore-end iron the round channel is enlarged to accommodate spring 544, shaft collar 545 and its retaining pin 546. The fore-end wood is reinforced by another collar 547 which also guides the shaft 541. The spring compartment extends into the fore-end iron. Beyond the wall of this compartment a two diameter stop 548 is threadably attached laterally through shaft 541.

The nose 549 of the shaft 541 is ground to a shape to fit and cam against the notch 550 in the underside of the rifle's knuckle 508 when the rifle is broken. Right hand cocking lever 506 is a conventional part of double firearms, the nose of which engages (for this sight) with the larger diameter, RH side of stop 548, when the rifle and sight are cocked.

Referring now to FIGS. 23 and 24, catch 551, a small trigger-shaped piece, is flexibly secured to the fore-end iron by the pin 552. Downward pressure is exerted by spring 553 on the catch extension which engages with the left hand arm of stop 548 when the rifle is opened. The trigger shaped tip of catch 551 protrudes from a hole in the fore-end iron under pressure of spring 553 whenever the rifle is broken and the catch tip is relieved of contact with the knuckle 508. As the action is closed, the knuckle 508, working against the concave trigger-shapped tip of catch 551, pushes the catch back into the fore-end iron, removing it from contact with the stop 548.

OPERATION

For all embodiments of my invention using screw-adjusted and secured sight leaves, the following "sighting-in" instructions are applicable.

Having installed the sight on the firearm and a comparably high front sight (e.g. the sight of FIG. 3) at the muzzle, the shooter should adjust the sight leaves to the impact of the rifled slugs (or bullets if installed on a rifle). This should be done by the traditional method of first firing several shots from each barrel with the sights unadjusted, and then making adjustments by trial and error on the results of these and subsequent test shots. To anticipate the rapidity with which the second barrel is often fired, and to make allowance for the effect of barrel heating caused by the first shot, affecting the impact of the second barrel, the second barrel of the firearm should be fired within 12 seconds of the first.

If the sight needs lateral adjustments, substitute sight leaves are required for these embodiments. These leaves would have their screw adjustment slots (e.g. FIG. 1, 135) in different lateral relationships to the "V"-shaped sighting notch. These would be supplied with the sight and each would be reversible to make each leaf suitable for left or right adjustments. If the heads of the adjustment screws 134 were wide enough, and sight leaf adjustment slots 135 slightly wider than the screws' thread diameters, minor windage adjustments could be made without replacing the leaves, by loosening the screws 134 and pushing the sight leaves to the edge of the slack in the adjustment slots 135 before retightening screws. The adjustments mentioned are made using the alternating sights in the order and manner they will be used in the field, the details of whcih will now be described.

Referring now to the sight of FIGS. 1 and 2. and the similar aspect of the sight in FIGS. 4, 5, 6 and 7. For best functioning (especially on O/U firearms). Sight leaf 132 is adjusted for the impact of projectiles from the first (lower) barrel to be fired. Sight leaf 133, is set for the second barrel. Thus when preparing to shoot, the sight is positioned as in FIG. 4. The shooter aims over sight leaf 132.

As the shot is fired the firearm and sight body (and most other sight parts) move suddenly backwards under recoil, or to the left relative to the drawings in FIGS. 4 through 7. The heavy inertia weight 121 however, is slower to start its backward journey than other parts of firearm and sight and moves forward, with its shaft 122(A) in relation to the body and shaft housing, and against the spring 124. This action pulls on connecting piece 125 (pinned to shaft 122) which pulls on brackets lugs 137, to which connecting piece 125 is also pinned. Bracket 137 has been lying beneath sight leaf 132 at an angle of 45 degrees below hinge pin 139's alignment with inertia shaft pin 123 and the direction of shaft 122's pull. Connecting piece 125 seeks to bring itself into this alignment (though it is curved to avoid fouling the sight bracket 131) and to bring the bracket lugs 137 and pin 138 into line as well.

Figure 5:
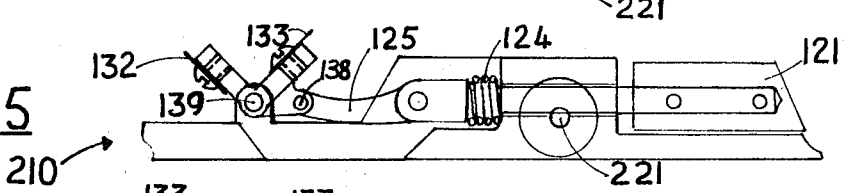
FIG. 5 is a visible side view of the sight of FIG. 4 during the recoil of the gun or rifle it is mounted on. This view also represents the position of the sight while the rear "drop-down" sight of FIG. 4 is being used, when the cross bolt (Item 221) is engaged to ensure the reciprocating sights leaves do not obsecure the view over the long-range sight leaves.

Thus, under this pull, the sight moves to the position shown in FIG. 5. The speed of this action, however, plus the momentum built up by the solid sight-mounting angles of bracket 131, and the attached sight leaves, carries the lugs beyond the line of hinge pin 139 and the inertia shaft. This action is enhanced if the bracket angle or plane on which sight leaf 132 is fixed is longer than the other bracket angle (to allow the necessary elevation for the lower barrel of an O/U firearm) as this will counterbalance the bracket lug 137 and connecting piece 125, even if recoil is weaker than desirable. Once this has happened, recoil will have subsided and inertia shaft spring 124 will push rearward once more, completing the travel of bracket 131 and lug 137 which have gone over their centre points as shown in FIG. 5, to rest under spring pressure in the FIG. 6 position.

Sight leaf 133 is now presented for the aiming of the second shot from the second barrel, for which the leaf has been adjusted. When the shot is fired recoil causes the action of the sight at the first shot to be repeated, but with the sight bracket moving in the oppisite direction. The provision of a longer bracket angle for sight leaf 132 should not normally impede this returning action, as the bracket angle of leaf 133 will be assisted initially by the same inertia effect which moves the inertia weight from its normal location.

Thus the sight has by reciprocal action reset itself for use when the firearm is reloaded.

The crossbolt 221 shown in FIGS. 4, 5, 6, and 7 is a provision for fixing the sight described above in the FIG. 5 position to prevent fouling the sight picture over long-range "drop-down" auxiliary sight 310. While this sounds unnecessary, a high-elevation general-use sight for the lower barrel of an O/U weapon, might be higher than the long-range provision for the upper barrel.

The crossbolt is used by either pulling gently forward on the knurled sides of inertia weight 121 with thumb and fore finger while pushing the cross bolt to the left into its concave with another finger or manipulating the sight bracket to the FIG. 5 position before engaging the crossbolt. This action puts a piece of metal in the notch of inertia shaft 122A and prevents it moving back or forward. The crossbolt is disengaged by pressing from the left side of the sight body.

Referring now to the sight of FIGS. 4, 7, 8, 9, 10 and 11. The sight shown on the left sides of FIGS. 4 and 7 and in detail in FIGS. 8 through 11 is meant for occasional use only and is therefore manually set and not coninually adjustable. To save bulk, the sight brackets are not furnished with screw-secured sight leaves, the leaves to be fastened with strong glue such as epoxy resin. Aligning the sight leaves is therefore difficult without a special collimator.

To align sight leaves without a collimator, several shots are fired from each barrel over low fixed sights at a large sheet at the extended range required, (with twelve seconds or less between firing first and second barrels) from each barrel. A bench rest should not be used though elbows may be rested on a support. Successive pairs of shots should be spaced several minutes apart to avoid excessive barrel heating and consequent impact changes. An observer should note which holes in the target are attributable to which barrel, and the centre of the group from each barrel noted. Using a low rear sight for aiming, these shots, should fall below the aiming point. No more shots should then be fired until sight leaves are adhered and the glue is dry. A conspicuous square or round target patch is then placed (temporarily) over the centre of the group from the first barrel.

The firearm is aligned once more on the original aiming point while held in a solid rest or vise at the point from which the shots were fired. The sights of FIG. 8 are raised, without moving the firearm, to the position shown in FIG. 9 (though the sight leaves 340 and 341 will not yet be attached). The sight bracket 331 and sight leaf 340 are carefully glued in the position where the "V" of the sight leaf aligns with the front sight and the temporary target patch. A small clamp or clip may be used to improve adhesion. The sight bracket 331 is then carefully folded to a position as close as possible to that of FIG. 10, without disturbing either the sight leaf's or firearm's positions, if clamping arrangement allows, the sight bracket 335 should be folded down over sight bracket 331 to check that the fixed sight is aligned on the original aiming mark. Bracket 335 is then returned to the vertical position shown in FIG. 10. The temporary target patch is removed from the first barrel's projectile impact centre, and placed over the impact centre of the projectiles from the second barrel. Sight leaf 341 is then adhered to bracket 335 in line with the temporary target patch and the front sight. Clamping the glued components if necessary, the firearm should be carefully put aside until the adhesive dries, preferably without being transported in a vehicle.

The operation of the sight of FIGS. 8 through 11, once its sight leaves are aligned is as follows:

To set the sight for use, the knurled resetting grips of the lead-cored inertia drum 334 are grasped between thumb and forefinger, and pulled up and back, the assembly hingeing arount the pin 339, until the sight leaf 341 comes to rest against the backrest 213.

The knurled drum is then pushed forward again until bracket 331 comes to rest at the vertical position shown in FIG. 9, as the spring 321 settles against the flat surface 342. Further travel is resisted by the less-yielding, though radiused edge 343. The sight is now set for aiming the first shot, from the barrel aligned for sight leaf 340. At the shot, the firearm and sight body move back (to the left of FIGS. 8, 9 or 10) under recoil. The inertia of the heavy lead core of drum 334, however, causes bracket 331 to hesitate at this sudden movement, and to topple forward (to the right in FIGS. 9–10) overcoming the resistance of the spring 321 to the radiused edge 343. As the bracket does so and continues to topple, the angular tripping extension 333 picks up tripping piece 338 extending from between the arms 336 of the bracket 335. This action pushes bracket 335 away from the backrest 213, up to the vertical position shown in FIG. 10, where it is halted by the protruding edge 344 failing to overcome the spring 321 at a time when recoil inertia has subsided.

The sight is now set for the aiming of the second shot over sight leaf 341. Depending upon the strength of spring 321, the weight and material of bracket 335, and the exact angles and dimensions of arm 336 at the protruding edge 344, the bracket 335 may or may not also topple forward at the recoil of the second shot.

Toppling is desirable if this action can be relied upon without endangering the stopping of bracket 335 at the FIG. 10 position after the first barrel is fired. This is because more than two shots at a game animal at long range are likely to be rare when the firearm must be reloaded before the extra shots can be fired. Therefore the automatic folding away of long range sights once used will generally be helpful. If however, further long-range shots are required it is felt the shooter is more likely to reset the sight if the obviously required sight has disappeared completely, than if one leaf of it is still standing. In the latter case, the shooter may absent-mindedly fire the first barrel using the sight leaf aligned for the second one-missing or wounding the animal as a consequence.

Referring now to the sights of FIGS. 12 through 21. Though of two variations these sights are basically similar, and certain views of one version are useful in understanding the other. Having adjusted the sight leaves as described beneath the "Operation" subheading, these sights function in the following manner.

Figure 14:
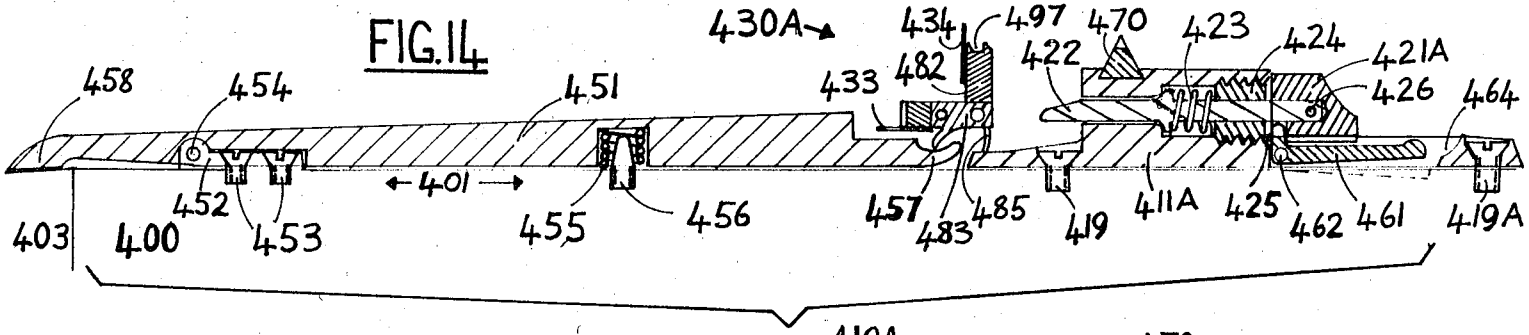
FIG. 14 is a centre-line side-view section of a sight of the FIGS. 12 & 13 type, but with a more complex folding sight bracket assembly and the addition of a fixed rear sight for close range use and emergency release mechanism to alternate the sights if the first catridge fails to fire. The sight bracket is shown in the uncocked position, as was the sight of FIG. 12.
Figure 15:
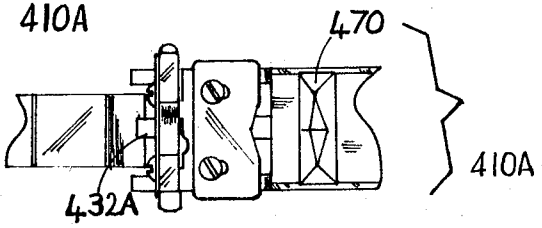
FIG. 15 is a plan view of the sight bracket and fixed sight portion of the sight of FIG. 14 but in the cocked position of FIG. 16.
Figure 16:
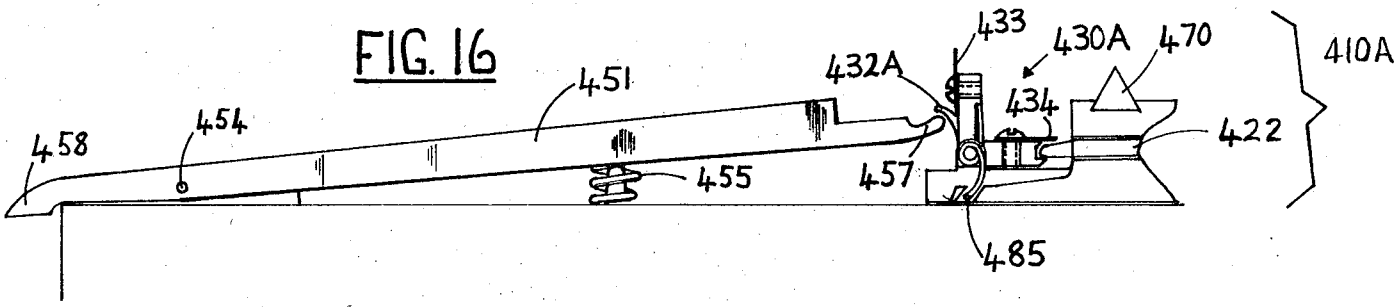
FIG. 16 shows an elevation of the FIGS. 14 & 15 sight as it is being cocked by the opening (breaking) of the arm it is mounted on. The view also reveals the torsion aspect of the sight bracket spring 485.

The operation of the sight in FIGS. 12, 13, 19 and 20 may be compared with that of the similar sight in FIGS. 14, 15 and 16. FIG. 14 shows the sight uncocked as it will be after one or both shots from the firearm had been fired, with sight leaf 434 uppermost. As the firearm is opened for reloading, the spring 455 forces the nose 457 of cocking lever 451 upwards as the foot 458 is freed from contact with the firearm's standing breech 403. As nose 457 rises, it bears against the cocking spur 432A causing it to rotate the sight-leaf assembly 430A through 90 degrees to the position shown in FIG. 16, where the springloaded inertia shaft 422 slips over the lip of the sight bracket 482, into the groove 497, retaining the sight leaf assembly in that position when the firearm is loaded and the action closed, returning the cocking lever 451 to its position in FIG. 14. The first shot may then be aimed over sight leaf 433. At the shot, recoil moves the firearm 400 and sight body 411A backwards (to the left in FIGS. 14, 15 and 16). Inertia weight 421A however, hesitates before starting this movement and pulls the inertia shaft 422 forward in its housing against the spring 423. Thus the shaft disengages from groove 497, and sight leaf assembly 430 rotates instantly back to its position in FIG. 14 under pressure from the torsion aspect of springs 485, where sight leaf 434 is presented for the immediate aiming of the second shot. The principal advantage of this sight over the embodiment of FIGS. 1, 2, 4, 5, 6 and 7 is that if the shooter wishes to reload his weapon after only one barrel is fired, the sight is automatically reset when the firearm is opened, whereas the sight of FIGS. 1 through 7 must be reset manually in such case.

The sight of FIGS. 12 through 21 also is less vulnerable to accidental tripping by vines and branches. It may also have a lighter inertia weight, needing less care in selection, especially when various loads or calibres are to be catered for.

A side benefit of this sight is that the downward pressure on the rifle's standing breech 403 by the nose 458 of cocking lever 451 and spring 455 can act as a self-opening device, if the firearm is well finished in its lock-up. The embodiment of FIGS. 1, 2, 4, 5, 6 and 7 is of course, self-contained and more suitable for compact, detachable models for double shotguns.

The operation of the additional features shown on the sight of FIGS. 14, 15, 16, 17, 18 and 21 is as follows:

Referring now to FIGS. 14 and 21, the emergency release lever 461 is used for tripping the sight leaf assembly 430A if the cartridge in the first barrel misfires (thus producing no recoil to release the sight mechanism when the shooter wishes to quickly fire an accurately aimed shot from the second barrel.

The operate this lever, the shooter presses his left thumb into the protective concave 464 (this should be possible with the firearm still to one's shoulder) and down on to the knurled-button end of the lever 461. Pivoting on pin 462, the lever then works against the inertia weight 421A pulling it and the inertia shaft 422 forward, releasing sight leaf assembly 430A to return to the second-barrel sight-leaf position. This provision is probably more important for hunters of wary animals such as deer than to hunters of dangerous game. If a dangerous animal were charging, the firing of the second barrel, after a misfire in the first, would probably be at such a short distance that fine accuracy would not be essential.

Referring now to FIGS. 14, 15, 16, 17, 18 and 21. The three piece sight bracket of sight leaf assembly 430A has three main purposes; to allow the alternating sight leaves to be folded away so that the fixed close range rear sight 470 may be used; to silence the mechanical noises of the alternating sight during loading when using the close range sight in conditions calling for quietness, even after shots have been fired; to make production of the sight bracket 430 possible by machining rather than casting-the cocking spur 432 making this prohibitive otherwise.

Having assembled the sight leaf assembly 430A in the folded position as explained in the Description and as shown in FIGS. 17 and 18, the sight may be brought into service as follows:

Sight leaf assembly 430A is gripped at curved surface 491 and RH mounting lug 412A between thumb and forfinger. While the middle finger presses down on any upward pressure from the cocking lever 451, the sight leaf assembly is squeezed together against the compression of springs 485. This unlocks the abutted flat surfaces of sight bracket 482 and the slightly protruding edge of cocking-spur bracket 483 (wedded to bracket 481) at 498, as the said edge of the cocking-spur bracket is pushed into the contoured niche 496. Once unlocked, the sight-bracket 481 side of the assembly may be rotated upwards, against the torsion aspect of springs 485, while maintaining the lateral squeeze against their compression. (This squeezing should not be too hard in case it should inhibit the torsion spring function).

Once sight bracket 481 reaches the vertical position, the said squeezing hold may be released (taking care the sight bracket 481 is not jammed or returned to the flat position by the torsion arms of springs 485). Releasing the grip on the sight allows cocking spur bracket 483 once more to lock against bracket 482, but now with bracket 483's back surface instead of one end. This new relationship is shown in the centre line-section view of the sight (uncocked) in FIG. 14.

When the shooter wishes to fold the sight flat once more, he should see that the sight is cocked, squeeze the sight assembly at the curved surface 491 and RH mounting lug 412A, and let the torsion arms of springs 485 fold the bracket down. Once more, pressure may be necessary on cocking lever 451 to reach the position where the brackets will lock in place when the squeeze is released. This need for pressure may depend on dimensional tolerances and the bending effect of cocking lever spring 455 upon the lever 451. The pressure is desirable however, if total silence of the sight when loading is required, as such pressure would take up all looseness throughout the sight which is likely to cause noise at that time.

The use of two springs 485 in this sight instead of one as in the basic version is a design expedient, which has an added benefit of adding reliability. As the strength of such springs is not critical, one could suffice if the other failed.

Referring now to FIGS. 22, 23 and 34. This sight is shown in less detail than the other embodiments, because it is an obvious rather than preferred embodiment. It is felt the complex nature of it and its needing (for best results) to be made as an integral part of the firearm, would prevent it having an significant cost-saving value in producing double rifles. It is an outwardly neater sight then the other embodiments and uses a solid quarter-rib useful for mounting other sights such as a fixed leaf or the long-range sight of FIGS. 8 through 11. The most significant apparent advantage of this sight is however, that the sight leaves are alternated when the firearm's trigger is pulled (and the hammer falls) whether the cartridge fires or not. This advantage is more fancied than real as modern cartridges seem rarely to misfire, and balanced by the chance that the mechanism of this sight, being connected with the firing mechanism may itself be the cause of ignition failure. For use against dangerous game which may be charging, reliability of ignition is more important than minor sighting problems. A rifle seen as worthy of the expense of installing this sight would normally be sufficiently accurate to do without the sight at close range. Unlike the self-cocking-inertia embodiment of FIGS. 12 through 21 which may act as a self-opening device for the firearm on which it is mounted, the sight of FIGS. 22, 23, and 24 could possible hinder the opening cocking action of the firearm.

Referring now to FIG. 22, the sight 510 is shown in its "cocked" position, ready to fire the first of two shots from the double rifle it is built into. (Such a sight would have little justification in a shotgun) sight leaf 533 has been aligned for the first (RH) barrel to be fired in the manner described at the beginning of the "Operation" section. When the trigger is pulled and the hammer released, the rifle's conventional pattern cocking lever 506 snaps upwards out of engagement with the RH arm of stop 548. Operating rod 541, no longer restrained by its member stop 548, is propelled back towards the rifle's knuckle notch 550 under the force of spring 544 acting against the rod's collar 545 from the forend collar 547. The nose 549 of the rod 541 comes to rest against notch 550, while at the other end of the rod the slot-linked lever 521 has pivoted around the pin 522 and working against the pin 537 between lugs 532 has alternated the sight leaf assembly 530 from the position shown in FIG. 22 to the opposite position where lugs 532 are angled forward. Sight leaf 534 is now in the vertical position and sight leaf 533 is lying horizontally, directly in front of quarter-rib 501. The sight leaf 534 is now presented for the aiming of the second shot, when the rifle 500 is opened (whether or not the second shot was fired), the sight is recocked. As the barrels 502 and forend hinge around the knuckle 508, the nose 549 of operating rod 541 is cammed back by notch 550 compressing spring 544 and "recocking" the sight leaf assembly 530 through the agency of lever 521. At the same time the rifle's cocking lever(s) 506 (and LH507) are being cocked by the coventional action of the forend iron. Because stop 548 is far below (or around the knuckle from) cocking lever 506 when it is fully reset by the camming of notch 550, an intermediary sear is required to keep stop 548 "cocked." until lever 506 can once more be engaged. This work is done by catch 551, which is shown in FIG. 23 (a plan of connecting rod 541 and fore-end iron components) and FIG. 24. Once the trigger-like tip of catch 551 is freed of the knuckle's constriction, as the fore-end iron reduces knuckle contact during opening, the tip protrudes from its opening in the fore-end iron under pressure from the spring 553. This pressure also pushes the spring-housing catch extension downwards to intercept the LH arm of stop 548 when it has been cammed back fully as the action is opened completely (as shown in FIG. 24). The catch extension gradually relinquishes its hold on stop 548 as the action is closed and the tip of catch 551 is once more forced within the fore-end iron by the knuckle 508. However, if the dimensions of the catch have been properly calculated, the final parting of catch 551 and the LH arm of stop 548 will not occur until cocking lever 506 has intercepted the travel of the RH arm of stop 548. Thus the sight leaf assembly 530 has been "recocked" by the opening of the rifle's action, and remains cocked until the right-hand barrel's firing mechanism is discharged, at which time the sight leaf 533 is instantly alternated for sight leaf 534, by the disengaging of cocking lever 506 as the firearm's hammer falls. Item 507 is the LH cocking lever.

While the above descriptions contain many specificities, these should not be construed as limitations on the scope of the invention, but rather as exemplifications of preferred embodiments thereof. Many other variations are possible, for example: hybrids of the embodiments shown (such as reciprocating sight with a cocking lever for automatic resetting when only one shot is fired before reloading firearm); electronically operated embodiments; aperture sight embodiments for use closer to the shooter's eye; sights using sight-alternating methods other than the hereinbefore described hingeing of two sights to roll back and forward (such as a sight for O/U firearms having a "drop-down" inertia sight for the lower barrel which disappears after the first shot to reveal a lower, fixed sight for the upper barrel); the use of an instantly alternating reticule for rifle telescopes to be used on double rifles (perhaps activated magnetically as was the Bushnell "Command Post" (a registered trade name) reticule where a heavy picket was superimposed over the normal crosshair for use in poor light); an alternating alignment sight, where one sight leaf is used and moved instantly to the second barrel position after the first shot. Accordingly, the scope of the invention should be determined not by the embodiments illustrated, but by the appended claims and their legal equivalents.

I claim:

1. Self-alternating sights for firearms such sights comprising;

a. An aiming means with two interchanging sight setting means, each of which is alignable with a separate point of projectile impact, at a selected distance, b. An alternating means which when set, automatically and instantly interchanges the said sight setting means when a shot is fired from a firearm on which said sights are mounted, c. A resetting means to return the alternated aiming means to its set position, d. A means for housing the said aiming, alternating and resetting means for attaching the said sights to said firearm.

2. The sights of claim 1 wherein said aiming means are rear sights for regulating convergence of separate points of projectile impact from each barrel of a a double-barrel firearm, such sights having hingeing means to cooperate with means for alternating and resetting the said aiming means rotatably back and forth in line with the barrels.

3. The sights of claim 2 wherein the alternating means is an inertia-weight element fixed to a spring-loaded shaft means which cooperates with the said hingeing and aiming means.

4. The sights of claim 3 wherein the aiming means are reset by a reciprocating means which is part of the alternating means, said reciprocating means being a connecting element linking the said shaft means with lugs so-placed on hinged aiming means that a sudden pulling action from the inertia weight element on the shaft means during recoil, which alternates the aiming means when one shot is fired, resets it again when another shot is fired.

5. The sights of claim 4 wherein the body means has several members including side-plate means which have a double purpose of first aligning the said aiming, alternating/resetting and body means for threadable attachment and second, clampably attaching the said sights to a ventilated rib on a firearm by means of tightening threadable attachment means on the sights (spacing and shaft-housing body parts between the said side-plate means having a width precisely that of the said firearms ventilated rib, plus allowance for any firearm-protecting means which is to be used between sights and said firearm); the clampable attachment is further affected by inserting and tightening further threadable attachment means through holes in the lower parts of the said side-plate means, these threadable attachment means passing through the said firearm's ventilated rib, with at least one of the said threadable attachment means bearing against the rear of a rib support of said ventilated rib.

6. The sights of claim 2 wherein the alternating means is principally a weighted member of a hinged aiming means, which interchanges the sight settings by falling over from a raised position under inertia during recoil, and the aiming means parts cooperating to elevate a second sight setting member as the first falls.

7. The sights of claim 6 wherein the resetting means are grip means with which the aiming means are reset manually.

8. The sights of claim 3 wherein the said spring-loaded shaft means fixed to the inertia-weight element functions as a release means cooperating with the aiming means which is rotatably spring-loaded by a torsion spring to alternate the aiming means, by maintaining said aiming means in a cocked position until the firearm is discharged whereupon the moving forward of the inertia weight pulls a sear means on the said shaft means out of contact with a retaining notch in the aiming means allowing the said aiming means to rotate under power of the said torsion spring.

9. The sights of claim 2 wherein the said aiming means are reset by a resetting means cooperating with the opening of the firearm on which the sight is installed.

10. The sights of claim 2 wherein the said sight is provided with an emergency alternating means with which the aiming means may be quickly alternated manually in the event of a malfunction in a firearm to which the sights are attached.

11. The sights of claim 2 wherein the hingeable aiming means may be foldably disengaged from a rigidly right-angular operating mode and stowed flat to allow the use of an alternative sighting means, and wherein an alternative sighting means for use at a different distance is provided.

12. The sights of claim 3 wherein the body means has a lateral hole and concaves at each end through the region of the shaft means through which a crossbolt means acts in cooperation with a notch in the said shaft means to lock the shaft means in a pre-determined position when required; such crossbolt means being applied by finger pressure in the said concaves.

13. The sights of claim 9 wherein the said aiming means are alternated in cooperation with the said firearm's own mechanism.

14. The sights of claim 6 wherein it is an auxiliary to other sighting means which are used for closer-range shooting.

15. Self-alternating rear sight means for double-barrel firearms which alignably regulate projectile impact, at a given distance, of each barrel of a double-barrel firearm, the said sight means comprising, a body means with means for being detachably installed on a rib along the said firearm's barrels' assembly, and means for hingeably mounting aiming means and for housing alternating and resetting means; an aiming means, being a right-angular element with an aperture at its tangent for hingeable mounting to the body means, and having slottedly adjustable sighting elements threadably attached to planes of the said right-angular element and with lug means extending from the outer surface of one said plane with a pivot means positioned on said lug means approximately 45 degrees around from the lug means' host plane in relation to the right-angular element's tangential aperture; and a combined alternating and resetting means, being a connecting element linked articulately with said pivot means of said lug means at one end and at its other end with a shaft element movably located in a longitudinal aperture through the body means and having between the said body means aperture and an enlargement of the shaft element where it joins said connecting element, a compression spring pushing the shaft element rearward towards the aiming means, this travel being principally limited by a rigidly fixed inertia weight element on the front end of the said shaft element ahead of the body aperture; and with the said self-alternating rear sight means constructed, assembled and mounted in such a way that when said double-barrel firearm is loaded a first shot may be aimed using one of the said sighting elements aligned for a point of projectile impact of one barrel, and that upon firing, recoil causes the sighting elements to be alternated for aiming a second shot and that recoil from the said second shot causes the sighting elements to be reset to their positions before the first shot.

16. Self-alternating rear sights, for double-barrel firearms, which alignably regulate impact of projectiles from each barrel of a double-barrel firearm at a given distance, the said sights having; a body means optionally a part of another sight-related structure and providing lugs for hingeably mounting aiming means, and contoured recesses for positioning springs and resting aiming means when folded away and when set for use; an aiming means, being two independently rotating sight leaf-mounting means (to be called the first sight means and the second sight means) on which sight leaves are alignably afixed by a fixing means; an alternating means, being a weighted inertia means at the outer end of the first sight means for tipping over the said first sight means under recoil, and a tripping means beneath the hingeable mounting for cooperating with the second sight means to lift it into view for aiming a second shot to be fired; a resetting means, being a grip means at the outer end of the first sight means which when pulled up and back through its arc of movement, lifts the second sight means, which is brought beyond vertical and rested against a resting recess in the body means, after which the first sight means is pushed forward again to the vertical position where it is located by a flat on its base bearing against a spring means; and said sights performing their alternating function by the weighted first sight means overcoming said spring means under the recoil inertia of a first shot from said firearm and toppling forward, and said spring means then locates the second sight means base when the second sight means is raised to the vertical position by the cooperation of said tripping means on the first sight means.

* * * * *